United States Patent [19]

Roy

[11] 3,975,777

[45] Aug. 24, 1976

[54] GARMENT CONSTRUCTIONS

[76] Inventor: Laura C. Roy, 122 Laird St., Greensburg, Pa. 15601

[22] Filed: Dec. 19, 1974

[21] Appl. No.: 534,282

Related U.S. Application Data

[63] Continuation-in-part of Ser. No. 427,825, Dec. 26, 1973, Pat. No. 3,859,667.

[52] U.S. Cl. ..... 2/211; 2/213

[51] Int. Cl.[2] ..... A41D 1/14

[58] Field of Search ..... 2/211, 212, 221, 220, 2/227, 235, 236, 237, 79

[56] References Cited

UNITED STATES PATENTS

| | | | |
|---|---|---|---|
| 1,283,092 | 10/1918 | Critcher | 2/212 |
| 2,138,230 | 11/1938 | Friedman | 2/212 X |
| 2,602,931 | 7/1952 | Myers | 2/211 |

FOREIGN PATENTS OR APPLICATIONS

| | | | |
|---|---|---|---|
| 626,624 | 8/1961 | Canada | 2/211 |

*Primary Examiner*—H. Hampton Hunter

[57] ABSTRACT

The garment construction comprises a waistline arrangement for encircling a wearer's waist, at least one front garment panel having an upper edge thereof secured to a front portion of the waistline arrangement, and at least one rear garment panel having an upper edge thereof secured to a rear portion of the waistline arrangement. A first lateral joining arrangement is provided for joining the left lateral edges of said garment panels, together with a second lateral joining arrangement for joining the right lateral edges of the panels. At least one of the lateral joining arrangements is quick-detachable to provide a closable garment opening thereby. Juxtaposed to the quick-detachable lateral joining arrangement is a quick-detachable waistline joining arrangement for detachably joining the ends of the waistline area. Front and rear garment panels have bifurcate configurations, together with means for quick-detachably joining the inward bifurcate edges of these panels to form a severable crotch for the garment construction, whereby the garment can be donned and doffed in wrap-around fashion.

Also disclosed is a quick-detachable means for joining a rear panel of the garment to the waistline arrangement so that the rear panel can be quickly detached from the waistline arrangement and from the crotch area of the garment. In this way the rear panel can be folded generally over the front panel of the garment for attendance to physical functions and the like. The severable waistline feature of my garment construction is also applicable to skirt type garments.

17 Claims, 17 Drawing Figures

GARMENT CONSTRUCTIONS

This application is a continuation-in-part of my pending application entitled GARMENT CONSTRUCTIONS, Ser. No. 427,825 filed Dec. 26, 1973, now U.S. Pat. No. 3,859,667.

My present invention relates to wearing apparel and more particularly to women's outer garments which can be donned and doffed readily and which facilitate attendance to physical functions.

There are many situations where it is undesirable, inconvenient or immodest to manipulate women's garments in the usual manner in attendance to the normal physical functions. Manipulation of the garments in the usual manner, as dictated by the conventional structure of the garments, frequently causes the garments to be soiled or wrinkled or to interfere with the wearer. In many instances, for example public washrooms, manipulation of the conventional garments forces undesired contact of the garments with the environment, which may be lacking in cleanliness. The disarray to which the garments are subjected at these times frequently results in soiling, snagging or wrinkling or other distortion of the garments, depending upon the material from which the garments are made.

Conventional garments in this category are often inconvenient and sometimes cumbersome to donn and to doff depending on the individual. With the modern trend toward tighter fitting, womens garments these difficulties are aggravated. In many cases a more than average sense of balance is required to step into or out of conventional garments and to perform the other motions required in putting on or taking off the garments. In many cases, particularly during donning of the garments the material tends to bunch up or otherwise to wrinkle or crease undesirably.

Although the present invention is directed primarily to womens garments, for example of the skirted-pant, pant-set, or mini-skirt variety, the invention is applicable to other women's garments and to certain male garments such as bermuda shorts.

According to the invention a rear panel of the garment can be folded across the front of the garment or the garment can be quickly removed during attendance to physical functions in order to preseve the preserve of the garment, prevent wrinkling or creasing, and/or to enhance the wearers modesty depending upon the circumstances. Unexpected means are provided according to the invention for quick-attaching and -detaching one or both of lateral joining means of the garment and for also quick-attaching and -detaching the crotch area of the garment. In consequence, the garment can be donned and doffed in wrap-around fashion much more quickly and conveniently in contrast to the usual dressing and undressing procedures. This also facilitates attendance to the normal physical functions. On the other hand, a surprising result is obtained in that an attractive and normally appearing garment is provided, upon securance of the several quick-detachable joining means of my novel garment. Surprisingly enough, the normal construction of my garment and the potential manipulation of the garment made possible thereby are concealed during the normal use of the garment, in accordance with still another feature of the invention. In another feature of the invention I provide means for thus manipulating the garment from either side of the wearer. Still other features of the invention involve reversability and interchangeability with similar garment configuration.

The principles of the invention can be readily applied to pant-sets, shorts, skirted-shorts, and over-skirt or over-shirt pant-set type garments and in general to bifurcate garments having a crotch. The crotch or transverse quick-detach means cooperate with longitudinal quick-detach means provided elsewhere in the garment, preferably at one side or other of the wearer (or both) to produce the aforementioned wrap-around effect when the garment is donned or doffed.

In accordance with another feature of my invention, unexpected means are provided to facilitate folding a rear panel or panels of the garment across the front panel or panels for attendance to physical functions as aforesaid. In this respect the present application is an improvement upon certain aspects of my copending application, Ser. No. 427,825. The latter feature of the present invention can be employed advantageously alone in connection with skirt type garments. However, with respect to the pant-set and shorts type garments mentioned above, the latter feature of my invention is most advantageously combined with the severable crotch feature of my invention.

I accomplish these desirable ends and overcome the difficulties of the prior art by providing a garment construction comprising waistline means for encircling a wearer's waist, at least one front garment panel having an upper edge thereof secured to a front portion of said waistline means, at least one rear garment panel having an upper edge thereof secured to a rear portion of said waistline means, first lateral joining means for joining the left lateral edges of said garment panels, second lateral joining means for joining the right lateral edges of said panels, at least one of said lateral joining means being quick-detachable to provide a closable garment opening thereby, quick-detachable waistline joining means for detachably joining ends of said waistline means in juxtaposition to said quick-detachable lateral joining means, said front garment panel having a bifurcate configuration said rear panel having a bifurcate configuration, and means for quick-detachably joining the inward bifurcate edges of said panels to form a severable crotch for said garment construction, whereby said garment can be donned and doffed in wrap-around fashion.

I also desirably provide a similar garment construction wherein an additional overskirt garment panel overlies at least said front bifurcated panel, said overskirt panel having an upper edge thereof joined to said waistline means.

I also desirably provide a similar garment construction wherein the other of said lateral panel joining means are also quick-detachable, and additional waistline quick-detachable joining means are juxtaposed to said other panel joining means.

I also desirably provide a similar garment construction including at least one additional substantially identical garment construction, said additional garment construction likewise having quick-detachably joining means in the crotch and lateral areas thereof so that a front panel of the first-mentioned garment construction can be joined to the rear panel of said additional garment construction and vice versa.

I also desirably provide a garment construction comprising waistline means, at least one front garment panel having an upper edge portion thereof secured to a front portion of said waistline means, at least one rear garment panel having an upper edge portion thereof detachably secured to a rear portion of said waistline means, quick-detachable securing means for so securing said rear panel upper edge portion to said waistline means, means for joining the left lateral edges of said garment panels together, means for joining the right lateral edges of said garment panels together, at least one of said lateral joining means being quick-detachable to provide a reclosable garment opening thereat, quick-detachable means for joining ends of said waistline means in juxtaposition to said detachable lateral joining means, whereby said rear garment panel can be substantially disengaged from said waistline means and from one side of said front garment panel and folded thereacross, said waistline means retaining said garment construction about a wearer's waist.

I also desirably provide a similar garment construction including said front garment panel and said rear garment panel each being bifurcated in construction, means for joining the inward bifurcate edges of said panels to form a garment crotch, said bifurcate edge-joining means being quick-detachable whereby said rear bifurcate panel can be readily detached additionally from said crotch and folded over said front bifurcate panel as aforesaid.

During the foregoing discussion, various objectives, features and advantages of the invention have been set forth. These and other objectives, features and advantages of the invention together with structural details thereof will be elaborated upon during the forthcoming description of certain presently preferred embodiments of the invention and presently preferred methods of practicing the same.

In the accompanying drawings I have shown certain presently preferred embodiments of the invention and have illustrated certain presently preferred methods of practicing the same wherein.

Figure 1:
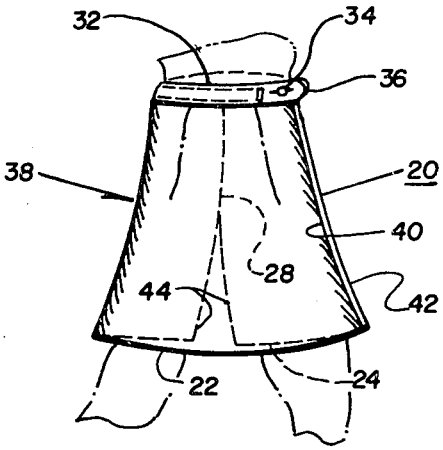
FIG. 1 is a front elevational view of a womans skirt and pant-set made in accordance with the invention.
Figure 2:
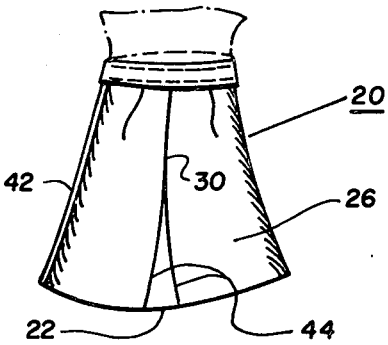
FIG. 2 is a rear elevational view of the skirt and pant-set shown in FIG. 1.
Figure 3:
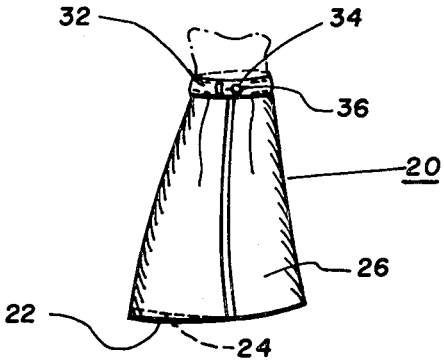
FIG. 3 is a left side elevational view of the garment shown in the preceding Figures.

With reference initially to FIGS. 1–4 of the drawings, a skirt and pant-set shown therein comprises a front overskirt panel 22, a bifurcate front panel 24 and a bifurcate rear panel 26. In the disclosed garment 20 the front and rear panels 24, 26 are joined by means described presently to form a pant-set or short configuration.

The front and rear panels 24, 26 can be conventionally bipartite and stitched at 28, 30 respectively for ease of construction and to provide the necessary or desired garment configurations complementary to the bodily contours of the wearer. The skirt and bifurcate panels 22–26 can be secured at their top edges to waistline means such as a waistband 32 the ends of which can be quick-detachably joined at the left side of the garment 20 by means of a button 34 and button hole or holed tab 36. Other forms of joining means can be substituted. Alternatively the waistband 32 can be joined at the right side (not shown in FIGS. 1–4) or at both sides after the manner of FIG. 9.

The overskirt panel 22 and the bifurcate front and rear panels 24, 26, in this example, are joined at their right side edges by suitably lateral joining means such as a line of stitching denoted generally by reference numeral 38. The left side edges of the overskirt 22 and the front bifurcate panel 24 are joined by a line of stitching 40, and these edges are in turn detachably joined to the left edge of the rear panel 26 by suitable quick-detachable lateral joining means, such as a full length zipper 42 or the like, as better shown in FIG. 4.

The inward bifurcate edges of the front and back bifurcated panels 24, 26 are joined to form a severable crotch 44 (FIGS. 1 & 2) of the garment 20 by suitable quick-detachable joining means such as zipper 46 (FIG. 4) desirably extending along the full length of the crotch or inseam 44. The zipper 46 can be sewn into the crotch 44 in the conventional manner of attaching zippers generally in garments which will avoid chafing the inner thighs of the wearer. My novel crotch configuration prevents the garment from gathering up into the wearer's crotch.

From the description thus far of the garment 20 it will be seen that the garment construction 20 can be put on or taken off in wrap-around fashion, by closing and opening the side zipper 42 and the crotch zipper 46, which are jacket-type or separatory zippers. Other similarly located fastening means can be employed such as plastic "zippers", "sticky" closures, snaps, buttons or skirt eyes and hooks. If a rear skirt panel (not shown) be employed in conjunction with the rear bifurcate or shorts panel 26, the shorts panel can be made shorter than the over-skirt panels.

My novel garment construction eliminates the necessity of stepping into or out of the garment or to draw the garment, in some cases, over tightly fitting areas. In general, manipulation of the garment is facilitated, particularly during attendance to physical functions, and the wearer has complete control of the garment at all times.

For further convenience during attendance to physical functions as noted previously, the garment 20 can be provided with means for securing the front panels 22, 24 independently about the waist of the wearer to permit temporary displacement of the back panel 26 and that portion of the waistband 32 attached thereto, as explained in detail below. In further accordance with the invention the back panel 26 can be folded out of the way and across the front panel or panels of the garment and temporarily secured in such position to prevent contact with the environment and soiling of the garment.

One arrangement for independently suspending the front panel or panels 22, 24 from the wearer's waist includes belt section or member 48 (FIGS. 4 & 5) having its inward end secured desirably to the front portion of the waistband 32 adjacent the top of the side seam 38 of the garment 20. The inward end of the belt 48 can be secured at this location by means of suitable, and desirably decorative, stitching denoted generally at 49. The length of the belt section 48 is such that the belt 48 and that portion of the waistband 32 extending along the front panel or panels of the garment 20 comfortably encircle the waist of the wearer. The belt section 48 can be made adjustable by fabrication from a length of elastic-and-cloth band or by use of conventional external adjustment means such as slip buckles. In the illustrated arrangement, the outward end of the belt section 48 is provided with a skirt hook 50 or the like for cooperation with a skirt eye or rod member 52 secured to the inside of the waistband 32 and preferably adjacent the holed tab 36 or other button hole thereof.

Figure 5:
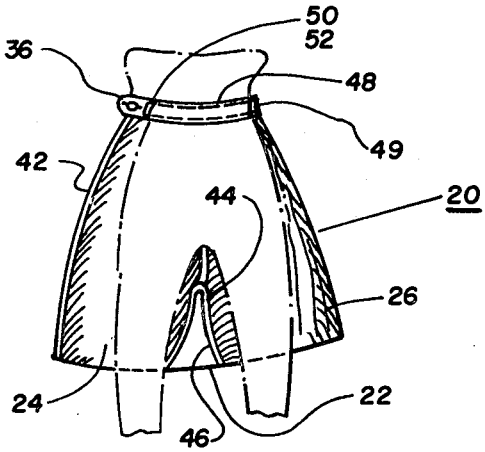
FIG. 5 is a rear elevational view of the garment shown in the preceding Figures, but with the back panel folded over the front panel thereof.
Figure 4:
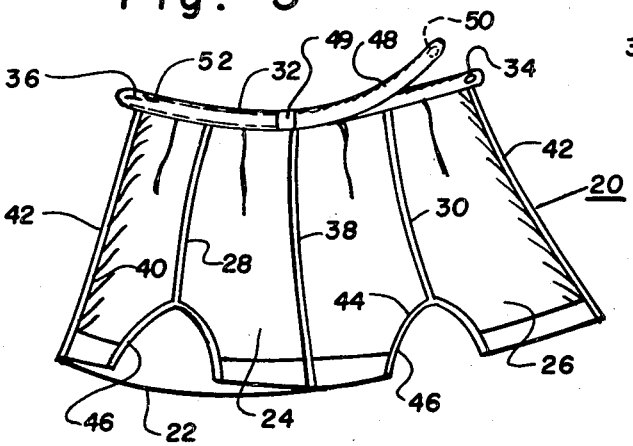
FIG. 4 is an inside plan view of the garment shown in the preceding Figures, with the several fastening means thereof disengaged to form a closable garment opening.
Figure 4A:
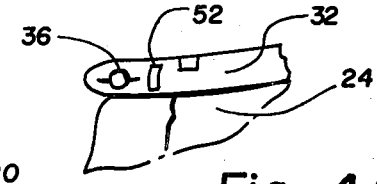
FIGS. 4A & 4B are somewhat enlarged partial views of the waistband and belt securement means.
Figure 4B:
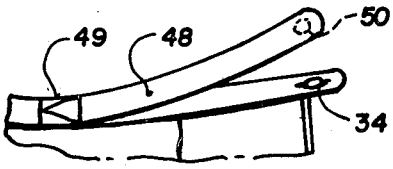

In the use of the garment 20, according to the invention, the garment is put on in wrap-around fashion by the wearer, with the side zipper 42 and the crotch zippers 46 undone or detached as shown in FIG. 5. The belt section 48 when provided is secured about the waist of the wearer and its free end is attached adjacent the holed tab 36 of the waistband 32 by means of the quick-detachable fastener 50–52. The unsecured or rear panel 26 is then brought around the rear of the wearer and its button 34 is fastened to the holed tab 36. The side zipper 42 and crotch zipper 46, or other suitable fastening means, are then closed to present the appearance of a conventional skirt and pant-set as evident from FIGS. 1–3 of the drawings.

Figure 6:
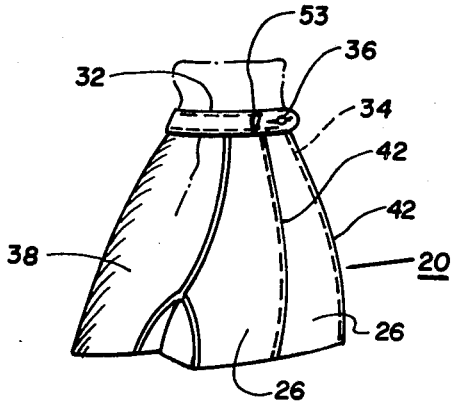
FIG. 6 is a front elevational view of the garment as illustrated in FIG. 5.

For attendance to physical functions the rear panel 26 of the garment can be disengaged at the crotch 44 and at the left side of the garment (or at the right side depending on zipper 42 location) by undoing the zippers 42, 46. The garment panel 26 thereupon can be folded around the front of the wearer and out of the way as shown in FIG. 6 and as described in greater detail in my aforesaid copending application Ser. No. 427,825. Alternatively the garment simply can be removed in a reverse wrap-around fashion to prevent soiling where the wearer is exposed to an unclean environment. In any event the garment is easily donned and doffed, a surprisingly advantageous situation in cramped quarters such as public washrooms and various types of camping or recreational vehicles.

It will be understood that a similar overskirt or skirt panel (not shown) can be secured to the rear portion of the waistband 32 so as to overlie the rear bifurcate panel 26 in much the same manner that the front skirt panel 22 overlies the front bifurcate panel 24. Thus, one or two garments panels can be attached to the front portion of the waistband 32, and likewise one or two garment panels can be attached to the rear portion of the waistband 32. It will be further understood that the waistband 32 need not be a continuous band of material (save for the holed tab opening or openings), but instead can be formed for example by a suitable hem formed in the upper edges of the several garment panels. Similarly the button 34 and related button hole can be formed in the respective upper corners of the garment panels adjacent the upper end of the zipper 42 or other side closure means. Thus, the upper edge portions of the garment panels can be utilized to form a waistline area or means for substantially encircling the waist of the wearer, or the waistline means can be defined by a separate waistband stitched as shown or otherwise secured to the upper edges of the garment panels.

It will be apparent that the principles of my invention can be readily applied to other forms of garments. For example, in FIG. 7, where similar reference numerals with primed accents denote similar components of the preceding figures, a pant-set 54 is illustrated. The pant-set 54 is constructed generally similar to the garment construction 20, with the principal exception that the overskirt 22 thereof has been omitted. The garment 54 is otherwise put on, taken off and/or folded across the front as desired, in the manner described previously in connection with the garment 20.

It will be apparent from the shorts-type garments shown in FIGS. 1–7 (and also in FIG. 8 described below) that the belt section 48 or 48′ can be omitted, if only the wrap-around feature of the invention is desired.

Figure 7:
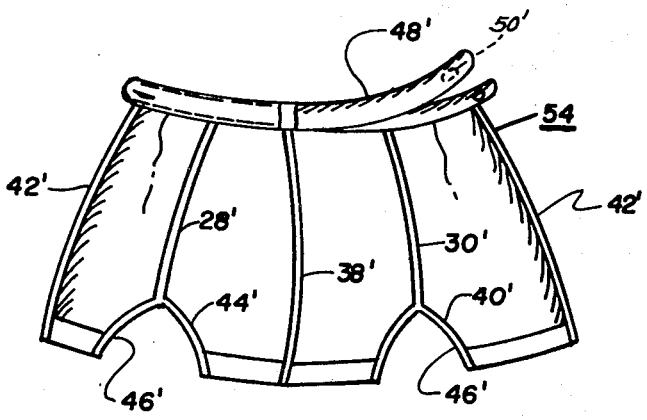
FIG. 7 is an inside plan view similar to FIG. 4, but illustrating a womens pant-set made according to the invention without an overskirt panel.
Figure 8:
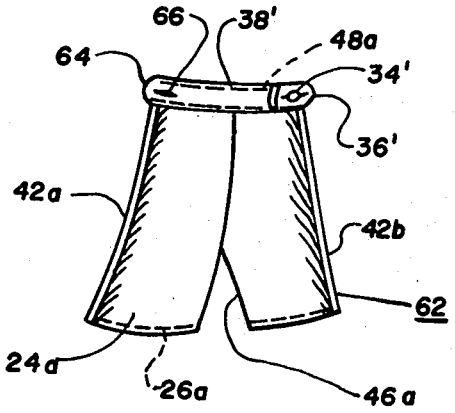
FIG. 8 is a front elevational view of a garment construction similar to that shown in FIG. 7 but having opening means at both sides of the garment for selectively folding the rear panel thereof in either direction over the front panel.

FIG. 8 shows another unexpected feature of my invention embodied in a shorts-type garment 62, similar to that shown in FIG. 7. In place of the side seam **38*a* of FIG. 7, the garment 62 is provided with a second and right side quick-detachable joining means such as zipper 42*b*, which is similar to the left side zipper 42*a* of FIG. 9 and to the side zipper 42, 42′, or 42″ of the preceding figures. Likewise the crotch zipper 46*a* is similar to the crotch zipper 46′ of FIG. 7.**

The waistband **38*a* of FIG. 8 is provided with a second holed tab 64 for cooperation with a second button 66 similarly located on the back panel 26*a*. The garment 62 can also be provided with belt section 48*a* as in the preceding figures. The belt section 48*a* is permanently secured at one of its ends to one upper corner of the front panel 24*a* and detachably secured at its other end to the other upper front corner of the front panel. The rear panel 26*a* can be unzippered at either the left side or the right side of the garment 62 and folded in the related direction over the front panel and temporarily secured either by its button 34*a* or 66 to the holed tab 36*a* or 64 respectively of the front panel 24*a*. That is to say the garment 62 can have its rear panel 26*a* folded along either its right side zipper 42*a* or its left side zipper 42*b*** by first undoing the other zipper and the related button.

The garment 62 can be put on, taken off, or folded across the front after the manner described in connection with the garment 20 of FIGS. 1–6, with the additional feature that the garment 62 can be opened at either side of the wearer (along with opening its crotch zipper 46*a*).

The garment of FIG. 8 provides new horizons of reversibility and interchangeability. For example, assume that an individual owned identical garments, each of which is provided with a zipper at each side. Now, if the two garments were of differing colors the individual could produce four different garments, as the front panel of one garment can be attached to the rear panel of the other garment and vice versa. If the two garments were also reversible in accordance with conventional techniques of fastening the zippers therein and the like, and if the inside surfaces of each garment had respectively differing colors and/or designs, then from the two garments the individual could produce a total of at least 16 color and/or design combinations. In arriving at this number of combinations a garment with color A at the front panel and color B at the rear would be considered one combination while a garment with color B at the front and color A at the rear would be considered an additional garment combination.

Figure 9:
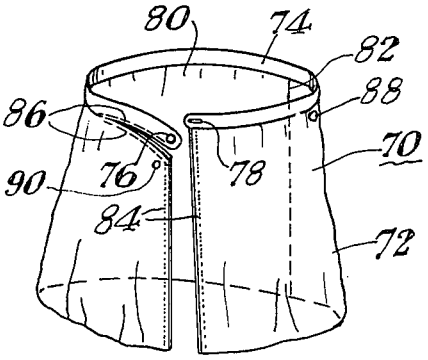
FIG. 9 is a front facing perspective view of another garment construction of the invention embodying an alternative waistband arrangement.
Figure 10:
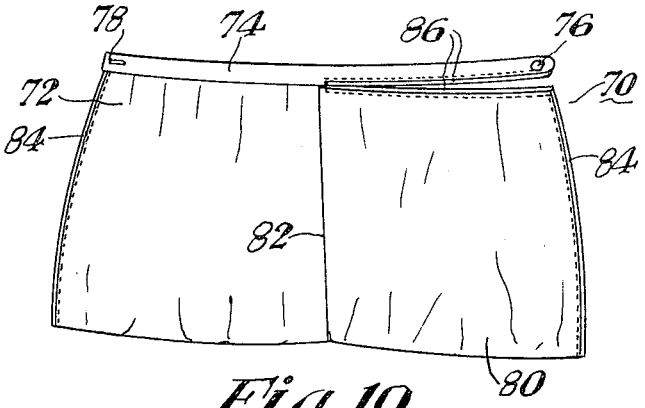
FIG. 10 is an outside plan view or pattern of the garment of FIG. 9.
Figure 11:
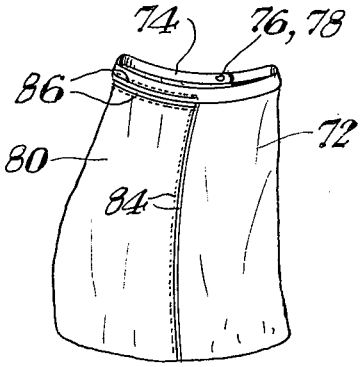
FIG. 11 is a right side elevational view of the garment of FIG. 9.

In FIGS. 9–11 of the drawings, a mini-skirt 70 or similar garment is illustrated with an alternative waistband arrangement. The garment 70 includes a front panel 72 permanently joined to waistband member or section 74 desirably provided with a button and button hole 74, 76, 78 or other suitable fastener, for securing the waistband means 74 about the waist of the wearer. The garment 70 is provided with a complementary rear panel permanently joined in this example at seam 82 to the front panel 72 usually at the left side of the garment 70. In the illustrated example the rear panel is detachably joined at the right side of the garment by means of a zipper 84 or other fastening means such as a row of snaps or buttons or by means of a Velcro friction fastener. In accord with my invention the rear panel 80 is further and unexpectedly detachably joined to the waist band 74 by means of a zipper 86 or other suitable closure means such as mentioned above. For attendance to physical functions, the rear panel 80 of the garment 70 can be quick-detached from the balance of the garment by undoing the fasteners 84, 86, whereupon the rear panel 80 can be folded at the left side of the garment 70 and folded generally over the front panel 72. The folded condition of the garment 70 can be temporarily maintained, as desired, after the manner described below in connection with FIG. 14.

The provision of means for the detachably joining rear panel to the waistband member or section or area 74 of the garment 70 allows the garment 70 to be folded as noted previously, without provision of a discrete belt member such as that illustrated in FIGS. 1–8 of the drawings. The aforementioned belt member is unnecessary as the waistband means 74 continues to encircle the waist of the wearer and thus continues to support the folded garment 70 on the wearer.

When the garment 70 is thus folded, another unexpected result of this feature of my invention is the elimination of the necessity of undoing the fastener 76–78, which of course retains the waistband means 74 about the wearer. The front and rear panels 72, 80 can be provided with a snap arrangement 88, to retain the rear panel in its folded condition, after the manner of FIG. 14.

Figure 12:
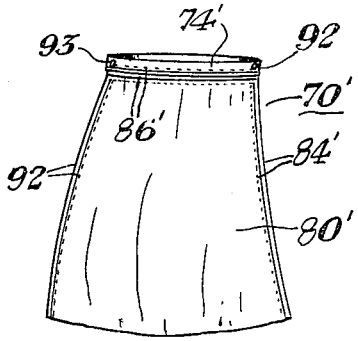
FIG. 12 is a rear elevational view of a garment construction similar to that shown in FIGS. 9–11 but embodying an alternative closure arrangement.

A similar garment construction 70′ is shown in FIG. 12, where similar reference numerals with primed accents denote similar components of FIGS. 9–11. The garment construction 70′ is endowed with the unexpected reversibility and interchangeability features disclosed above in FIG. 8. For this purpose the garment 70′ is provided with a left side zipper 92 or other fastener in addition to the usual right side fastener 84′. Hence the rear panel 80′ can be completely removed from the garment 70′ by undoing the zippers 84′, 86′ and 92 for the purpose of reversing the rear panel 80′ or substitution of another panel. In the garment 70′ the waistline 74′ desirably is provided with a second quick-detachable joining means 93 juxtaposed to the upper end of the closure 92.

Another advantageous feature of the garment 70′ is its capability of being folded along its left side as in FIGS. 9–11, by undoing the right side zipper 84′ and the waistband zipper 86′, or alternatively, folding along its right side by undoing the left side zipper 92 and the aforementioned waistband zipper 86′. In either case the rear panel 80′ can be folded over the front panel and temporarily retained in that position after the manner of FIG. 14.

Figure 14:
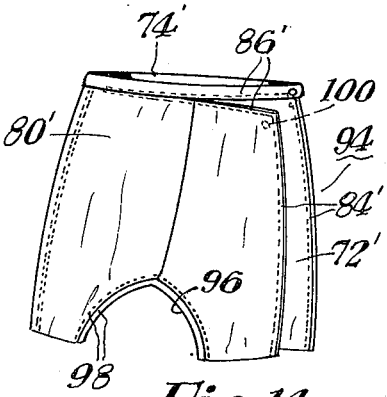
FIG. 14 is a front elevational view of the garment shown in FIG. 13 but having the rear panel thereof folded over the front panel.
Figure 13:
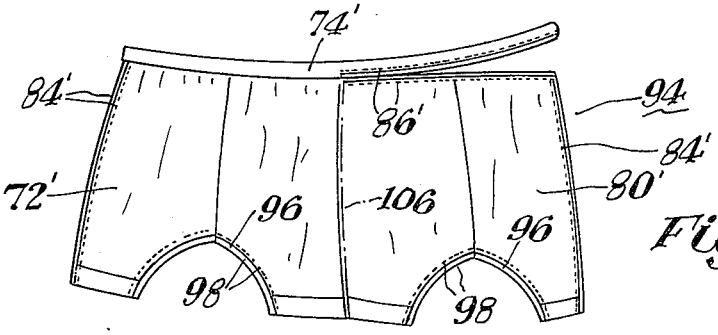
FIG. 13 is an outside pattern plan of still another garment construction of the invention and showing the alternative waistband means of FIGS. 9–12 in combination with a severable crotch.

In FIGS. 13 and 14 of the drawing, where reference numerals with primed accents denote similar components of FIGS. 9–11, the severable waistband feature of the invention is embodied in a pantset type garment 94 having a severable crotch after the manner of FIG. 7 and other Figures of the drawings. The front and rear panels 72′, 80′ of the garment 94 are bifurcated to define the aforementioned severable crotch 96, which is provided with a zipper 98 or other suitable quick-detach fastening means. In the illustrated example the front and rear panel means 72′, 80′ are joined desirably at the right side of the garment, by a zipper or other suitable quick-detach means 84′. The rear panel 80′ is similarly and unexpectedly joined to the waist band means 74′ through zipper 84′ or other suitable means discussed previously. The rear panel 80′ of the garment 94 can be folded over the front panel as shown in FIG. 14, by undoing the crotch zipper 98, the side zipper 84′, and the waistband zipper 86′. As evidenced in FIG. 14 the rear panel 80′ can be maintained temporarily in its folded condition by means of a suitable snap arrangement 100 or other suitable fastening arrangement.

Figure 15:
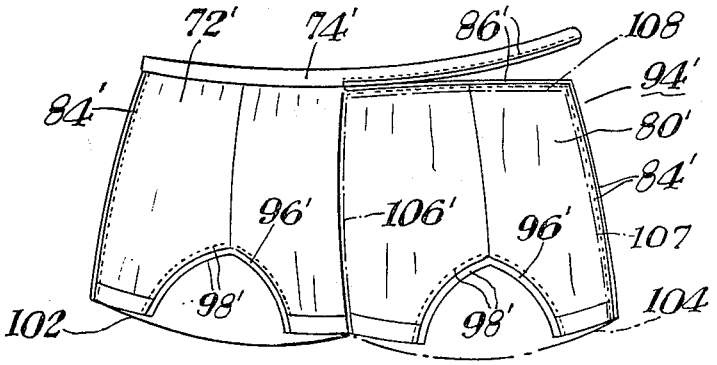
FIG. 15 is a view similar to FIG. 13 and showing the alternative waist band means and severable crotch in a skirted shorts or pantset.

In FIG. 15, where similar reference numerals with primed accents denote similar components of FIGS. 9–11, 13 and 14 a skirted shorts or pant-set type garment 94′ is illustrated.

The garment 94′ is similarly provided with a waistband fastener 86′, a crotch fastener 98′ and a side fastener 84′. In addition, the garment 94′ is provided with a front over-skirt panel 102 after the manner of FIG. 1 of the drawings.

Alternatively or in conjunction therewith, the garment 94′ can be provided also with a rear overskirt panel as denoted by chain outline 104 thereof.

When the rear overskirt panel 104 is employed, its lateral and upper edges 107, 108 desirable are permanently joined adjacent the related edges of the bifurcate rear panel 80′ so that the rear overskirt panel 104, when used, is thereby detachably joined to the front panel and to the waistline means 74′ along with the rear panel 80′.

It is also contemplated that the garment 94 of FIGS. 13, 14 and the garment 94′ of FIG. 15 can be provided with a left side fastener as denoted by chain outlines 106, 106′ thereof respectively used in conjunction with the right side fasteners 84′ after the manner of FIG. 12, or in substitution therefor.

With respect to the embodiments of my invention as illustrated in FIGS. 9–15, it is contemplated that the same can be donned and doffed in wrap-around fashion and for the purposes mentioned previously. Thus the garment 70 of FIGS. 9–11 can be donned by wrapping around the wearer's body, securing the waistband means 74 with the fastener arrangement 76, 78, followed by securing the rear panel 82 by closing the zippers 84, 86. To doff the garment 70 the procedure is reversed. Obviously the necessity for stepping into or out of the garment 70 is eliminated. The garment 70' of FIG. 12 can be donned or doffed similarly except either one of the side zippers 84' or 92 can be manipulated. The garments 94 or 94' of FIGS. 13, 14 or 15 can be similarly donned or doffed, with the exception that the crotch zipper 98 or 98' must additionally be manipulated.

Although the invention has been illustrated and described primarily in conjunction with skirt and pantset, and shorts-type garments, it will be readily apparent that the invention is applicable to a variety of wearing apparel. For example, the invention is applicable to tennis shorts, skating pantsets, tights, pant-sets of various lengths, slacks, slack suits (where there is no objection to a correspondingly lengthened crotch zipper along the inseams of the slacks or pants) palazzo pants, and culottes. The invention is likewise applicable to bermuda shorts, knickers and similar garments.

Although the invention is advantageously used for the aforementioned and other outer garments the principles set forth herein can also be applied to undergarments such as girdles, bloomers and panties.

The invention is also advantageously employed with sportwear and campwear for the purposes aforesaid. With the rapid rise in camping and sporting activities, increasing numbers of users of these types of garments are encountering outdoor and other relatively primitive facilities in their travels. In these situations relatively unclean environments and other situations in which the garments can be readily soiled, creased or wrinkled, are likely to be encountered.

Further, in many dressing room accommodations and in various types of travel trailers, motor homes and other camping or recreational equipment, dressing room space is at a premium and at best is cramped. The wrap-around features of my invention can be used to advantage in these situations, as well as in other situations mentioned previously, where it is difficult for the wearer to maintain balance.

From the foregoing it will be seen that novel and efficient garment constructions have been described herein. The descriptive and illustrative materials employed herein are utilized for purposes of exemplifying the invention and not in limitation thereof. Accordingly, numerous modifications of the invention will occur to those skilled in the art without departing from the spirit and scope of the invention. Moreover, it is to be undersood that certain features of the invention can be used to advantage without a corresponding use of other features thereof.

I claim:

1. A garment construction comprising waistline means for encircling a wearer's waist, at least one front garment panel having an upper edge thereof secured to a front portion of said waistline means, at least one rear garment panel having an upper edge thereof secured to a rear portion of said waistline means, first lateral joining means for joining the left lateral edges of said garment panels, second lateral joining means for joining the right lateral edges of said panels, at least one of said lateral joining means being quick-detachable to provide a closable garment opening thereby, quick-detachable waistline joining means for detachably joining ends of said waistline means in juxtaposition to said quick-detachable lateral joining means, said front garment panel having a bifurcate configuration, said rear garment panel having a bifurcate configuration, means for quick-detachably joining said rear panel upper edge to said waistline means so that said rear panel is detachable from said waistline means and from at least one side of said front panel for folding therecross, and additional quick-detachable joining means for temporarily securing said rear panel to said front panel when so folded, means for quick-detachably joining the inward bifurcate edges of said panels to form a severable crotch for said garment construction, whereby said garment can be donned and doffed in wrap-around fashion.

2. The combination according to claim 1 wherein an additional overskirt garment panel overlies at least said front bifurcated panel, said overskirt panel having an upper edge thereof joined to said waistline means.

3. The combination according to claim 1 wherein the other of said lateral panel joining means are also quick-detachable, and additional waistline quick-detachable joining means are juxtaposed to said other panel joining means.

4. The combination according to claim 1 including at least one additional substantially identical garment construction, said additional garment construction likewise having quick-detachably joining means in the crotch and lateral areas thereof so that a front panel of the first-mentioned garment construction can be joined to the rear panel of said additional garment construction and vice versa.

5. The combination according to claim 4 wherein the garment panels of each of said garment constructions are finished on both sides so that said garment constructions are both interchangeable and reversible.

6. The combination according to claim 3 wherein said front and rear garment panels are each finished on both sides so that said garment construction is reversible.

7. The combination according to claim 1 wherein said bifurcate edge-joining means include a zipper-type closure.

8. The combination according to claim 1 wherein said inward bifurcate edges are joined along normal inseams of the garment construction.

9. A garment construction comprising waistline means, at least one front garment panel having an upper edge portion thereof secured to a front portion of said waistline means, at least one rear garment panel having an upper edge portion thereof detachably secured to a rear portion of said waistline means, quick-detachable, securing means for so securing said rear panel upper edge portion to said waistline means, means for joining the left lateral edges of said garment panels together, means for joining the right lateral edges of said garment panels together, at least one of said lateral joining means being quick-detachable to provide a reclosable garment opening thereat, quick-detachable means for joining ends of said waistline means in juxtaposition to said detachable lateral joining means, whereby said rear garment panel can be substantially disengaged from said waistline means and from one side of said front garment panel and folded thereacross, said waistline means retaining said garment construction about a wearer's waist.

10. The combination according to claim 9 including detachable fastening means for temporarily securing said rear panel across said front panel to retain temporarily said rear panel in the folded condition thereof.

11. The combination according to claim 9 wherein said lateral joining means and said waistline joining means each include a zipper-type closure.

12. The combination according to claim 9 wherein the other of said lateral panel joining means are also quick-detachable, and additional waistline quick-detachable joining means are juxtaposed to said other lateral joining means.

13. The combination according to claim 9 including said front garment panel and said rear garment panel each being bifurcated in construction, means for joining the inward bifurcate edges of said panels to form a garment crotch, said bifurcate edge-joining means being quick-detachable whereby said rear bifurcate panel can be readily detached additionally from said crotch and folded over said front bifurcate panel as aforesaid.

14. The combination according to claim 13 wherein said bifurcate edge-joining means include a zipper type closure.

15. The combination according to claim 13 including an overskirt panel positioned over said front bifurcate panel, said skirt panel having an upper edge thereof joined at least to said waistline means.

16. The combination according to claim 15 including an additional overskirt panel positioned over the rear bifurcate panel, said additional overskirt panel being joined directly to said rear bifurcate panel at least at the upper edge portion and at the detachable lateral edge portion thereof.

17. The combination according to claim 12 including at least one additional substantially identical garment construction, said additional garment construction having a rear panel member similarly joined to waistline means thereof so that the front panel of the first-mentioned garment construction can be joined to the rear panel of said additional garment construction and vice versa.

* * * * *